US010007225B2

(12) United States Patent
Nosho et al.

(10) Patent No.: US 10,007,225 B2
(45) Date of Patent: Jun. 26, 2018

(54) FEEDING DEVICE, PROCESS CARTRIDGE AND IMAGE FORMING APPARATUS

(71) Applicant: CANON KABUSHIKI KAISHA, Tokyo (JP)

(72) Inventors: Hiroaki Nosho, Suntou-gun (JP); Takatoshi Hamada, Mishima (JP); Yohei Kusano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/144,978

(22) Filed: May 3, 2016

(65) Prior Publication Data

US 2016/0334753 A1 Nov. 17, 2016

(30) Foreign Application Priority Data

May 15, 2015 (JP) ..... 2015-099904
Apr. 8, 2016 (JP) ..... 2016-078267

(51) Int. Cl.
*G03G 21/00* (2006.01)
*G03G 21/10* (2006.01)

(52) U.S. Cl.
CPC ..... *G03G 21/105* (2013.01); *G03G 21/0005* (2013.01); *G03G 21/0011* (2013.01);
(Continued)

(58) Field of Classification Search
CPC ..... G03G 21/105; G03G 21/0005
See application file for complete search history.

(56) References Cited

U.S. PATENT DOCUMENTS 4,470,689 A * 9/1984 Nomura ..... G03G 15/75 355/71
5,559,581 A 9/1996 Sugiura et al.
(Continued)

FOREIGN PATENT DOCUMENTS

JP H10-312142 A 11/1998
JP 2005-301019 A 10/2005
(Continued)

OTHER PUBLICATIONS

Extended Search Report in European Patent Application No. 16165718.4, dated Sep. 27, 2016.
(Continued)

*Primary Examiner* — Sevan A Aydin
(74) *Attorney, Agent, or Firm* — Fitzpatrick, Cella, Harper & Scinto

(57) ABSTRACT

A feeding device for feeding a developer includes a cleaning member, an accommodating portion, a feeding member, and a sheet member. A wall surface of the accommodating portion is positioned in a side where the sheet member is provided with respect to a rectilinear line connecting a rotation center of the image bearing member and a rotation center of the feeding member in a flat plane perpendicular to an axial direction of the image bearing member. The wall surface approaches the rectilinear line with an increasing level with respect to a vertical direction. The feeding member is provided vertically above a position where the cleaning member contacts the image bearing member. A rotational direction of the feeding member and a rotational direction of the image bearing member are the same.

14 Claims, 12 Drawing Sheets

(52) U.S. Cl.
CPC ..... *G03G 21/0029* (2013.01); *G03G 21/0035* (2013.01); *G03G 21/0058* (2013.01)

(56) References Cited

U.S. PATENT DOCUMENTS

| | | | | |
|---|---|---|---|---|
| 5,561,496 | A | 10/1996 | Sugiura et al. | |
| 5,634,178 | A | 5/1997 | Sugiura et al. | |
| 6,084,622 | A | 7/2000 | Sugiura et al. | |
| 6,374,074 | B1 | 4/2002 | Oono | |
| 6,692,882 | B2 | 2/2004 | Oshiba et al. | |
| 9,164,424 | B2 | 10/2015 | Nakamura et al. | |
| 2002/0110748 | A1 | 8/2002 | Oshiba et al. | |
| 2003/0053831 | A1 | 3/2003 | Maeshima et al. | |
| 2006/0177241 | A1* | 8/2006 | Sato | G03G 15/0862 399/254 |
| 2009/0196659 | A1* | 8/2009 | Handa | G03G 15/0875 399/255 |
| 2009/0214268 | A1 | 8/2009 | Noh et al. | |
| 2010/0322686 | A1* | 12/2010 | Yamamoto | G03G 21/105 399/358 |
| 2015/0205226 | A1 | 7/2015 | Komatsu et al. | |

FOREIGN PATENT DOCUMENTS

| | | | |
|---|---|---|---|
| JP | 2006-139084 | A | 6/2006 |
| JP | 2012-208276 | A | 10/2012 |
| RU | 2 405 180 | C2 | 11/2010 |

OTHER PUBLICATIONS

Decision on Grant in Russian Patent Application No. 2016116783, dated Oct. 20, 2017 (with English translation).

* cited by examiner

FEEDING DEVICE, PROCESS CARTRIDGE AND IMAGE FORMING APPARATUS

FIELD OF THE INVENTION AND RELATED ART

The present invention relates to a feeding device, a process cartridge and an image forming apparatus.

Here, the process cartridge is such a cartridge that an image bearing member such as an electrophotographic photosensitive drum is at least provided and that the image bearing member and, as process means actable on the image bearing member, at least one of a charging means, a developing means and a cleaning means, are integrally provided. Such a process cartridge is detachably mounted in a main assembly of the image forming apparatus. As the process cartridge, for example, a process cartridge prepared by integrally assembling the electrophotographic photosensitive drum and, as the process means, at least one of the developing means, the charging means and the cleaning means into a cartridge can be used.

Further, an electrophotographic image forming apparatus forms an image on a recording material (medium) using an electrophotographic image forming method. Examples of the electrophotographic image forming apparatus may include an electrophotographic copying machine, an electrophotographic printer (LED printer, laser beam printer or the like), a facsimile machine, a word processor and so on.

In the electrophotographic image forming apparatus, in general, an electrophotographic image forming apparatus, i.e., a photosensitive drum as an image bearing member is electrically charged uniformly. Then, the charged photosensitive drum is selectively exposed to light, so that an electrostatic latent image (electrostatic image) is formed on the photosensitive drum. Then, the electrostatic latent image formed on the photosensitive drum is developed as a toner image with a toner as a developer. Then, the toner image formed on the photosensitive drum is transferred onto the recording material such as a recording sheet or a plastic sheet, and then the toner image transferred on the recording material is subjected to application of heat and pressure and thus is fixed on the recording material.

Such an image forming apparatus requires toner supply and maintenance of various process means in general. In order to facilitate the toner supply and the maintenance, a process cartridge in which the photosensitive drum, the charging means, the developing means, the cleaning means and the like are integrally assembled into a cartridge in a frame is made detachably mountable to an image forming apparatus main assembly and has been put into practical use.

According to this process cartridge type, the maintenance of the devices can be made by a user himself (herself), and therefore operativity can be remarkably improved, so that it is possible to provide an image forming apparatus excellent in usability. For that reason, the process cartridge type has been widely used in the image forming apparatus.

In the process cartridge, in order to reduce a frequency of exchange, a constitution in which a toner collected from the photosensitive drum surface by the cleaning means is fed to a remoter position is studied. As a means for feeding this toner, a constitution using a screw, a brush roller or a collecting auger as a rotatable member has been known (Japanese Laid-Open Patent Application (JP-A) H10-312142, JP-A 2005-301019, JP-A 2012-208276).

However, in the case where the collected toner is fed at a portion above the photosensitive drum by the screw, pressure by the toner accumulated in a cleaning frame is applied to a contact portion between the cleaning member and the photosensitive drum, so that there was a possibility that a cleaning performance lowered.

SUMMARY OF THE INVENTION

A principal object of the present invention is to provide a feeding device, a process cartridge and an image forming apparatus which are capable of enhancing a feeding performance of a developer to a predetermined feeding path while suppressing a lower in cleaning performance due to application of pressure, to a contact portion between a cleaning member and a photosensitive drum, by a developer accumulated in a cleaning frame.

According to an aspect of the present invention, there is provided a feeding device for feeding a developer comprising: a cleaning member for removing the developer on an image bearing member in contact with the image bearing member; an accommodating portion for accommodating the removed developer; a feeding member for feeding the developer from the accommodating portion; and a sheet member contact the image bearing member, wherein a wall surface of the accommodating portion is positioned in a side where the sheet member is provided with respect to a rectilinear line connecting a rotation center of the image bearing member and a rotation center of the feeding member in a flat plane perpendicular to an axial direction of the image bearing member, wherein the wall surface approaches the rectilinear line with an increasing level with respect to a vertical direction, wherein the feeding member is provided vertically above a position where the cleaning member contacts the image bearing member, and wherein a rotational direction of the feeding member and a rotational direction of the image bearing member are the same.

According to another aspect of the present invention, there is provided a process cartridge including the feeding device.

According to a further aspect of the present invention, there is provided an image forming apparatus including the feeding device.

Further features of the present invention will become apparent from the following description of exemplary embodiments with reference to the attached drawings.

DESCRIPTION OF THE EMBODIMENTS

Embodiments of the present invention will be described in detail with reference to the drawings.

First Embodiment (General Structure of Image Forming Apparatus)

Figure 2:
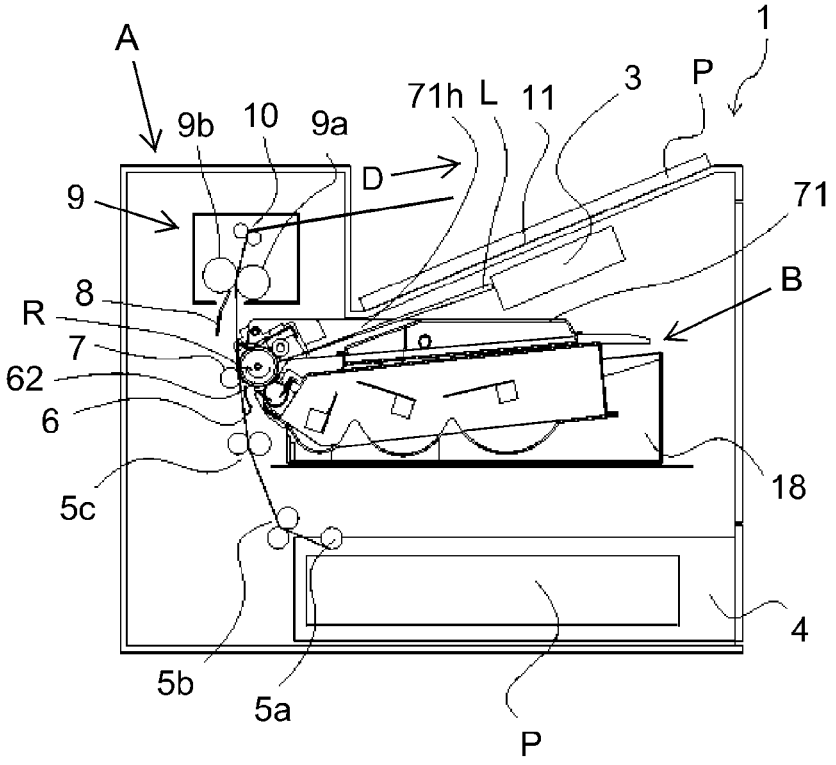
FIG. 2 is a sectional view showing a main assembly of an image forming apparatus in which the process cartridge in First Embodiment is mounted and showing the process cartridge.

An image forming apparatus 1 of an electrophotographic type shown in FIG. 2 is a laser beam printer, using electrophotography, in which a cartridge B as a process cartridge is detachably mountable to an apparatus main assembly A.

In the following description, a rotational axis direction of an electrophotographic photosensitive drum as an image bearing member is a longitudinal direction. Further, with respect to the longitudinal direction, a side in which the drum receives a driving force from the apparatus main assembly A of the image forming apparatus is a driving side, and an opposite side thereof is a non-driving side. The apparatus main assembly A is a portion from which the cartridge B as the process cartridge is removed. When the cartridge B is mounted in the apparatus main assembly A, an exposure device (laser scanner unit) 3 for forming an electrostatic latent image on the drum 62 is provided in the apparatus main assembly A. Further, below the cartridge B, a sheet (feeding) tray 4 in which a recording material (sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

(General Structure of Cartridge)

Figure 3:
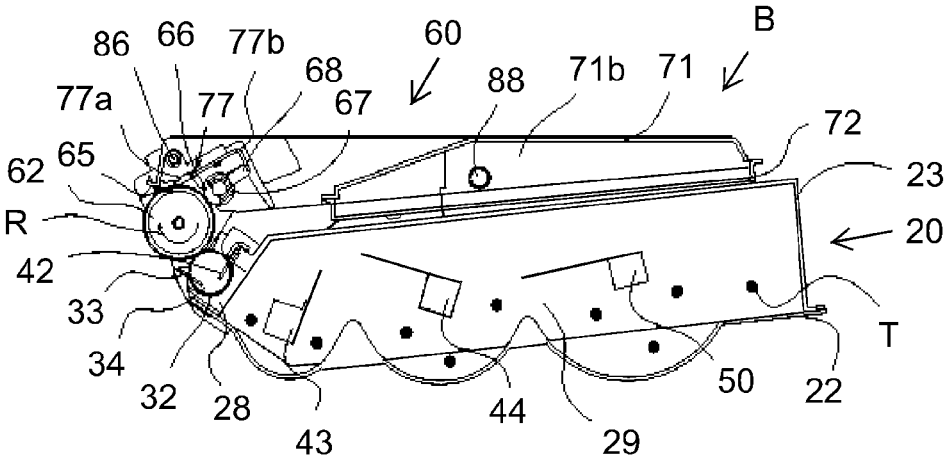
FIG. 3 is a sectional view of the process cartridge in First Embodiment.

A general structure of the cartridge B will be described using FIG. 3. FIG. 3 is a sectional view of the cartridge B. In this embodiment, description will be made by omitting screws during connection of respective components.

In this embodiment, the cartridge B which includes a cleaning unit 60 including a feeding mechanism (feeding device) for feeding a developer and includes a developing unit 20 and which is prepared by connecting the cleaning unit 60 and the developing unit 20 will be taken as an example and will be described.

The cleaning unit 60 includes the drum 62, a charging roller 66, a cleaning member 77, a cleaning frame 71 supporting these members, and a cap member 72 fixed to the cleaning frame 71 by welding or the like. In cleaning frame 71 and the cap member 72 are integrally provided for forming a residual toner chamber 71*b* which is an accommodating space in which the developer removed by the cleaning member 77 is accommodated. Further, the charging roller 66 and the cleaning member 77 are disposed in contact with an outer peripheral surface of the drum 62.

The cleaning member 77 includes a rubber blade 77*a* which is a blade-shaped elastic member formed of a rubber as an elastic material, and a supporting member 77*b* for supporting the rubber blade 77*a*. The rubber blade 77*a* is contacted to the drum 62 counterdirectionally to a rotational direction R of the drum 62. That is, the rubber blade 77*a* is contacted to the drum 62 so that a free end portion thereof is directed upward with respect to the rotational direction R of the drum 62.

Incidentally, as shown in FIG. 3, in this embodiment, a drum contact sheet 65 which is a sheet member for preventing leakage of a residual toner from the cleaning frame 71 is provided at an edge portion of the cleaning frame 71 so as to contact the drum 62.

The drum 62 is rotationally driven in an arrow R direction in FIG. 3 depending on an image forming operation by receiving the driving force from a main assembly driving motor (not shown) which is a driving source. The charging roller 66 is rotatably mounted to the cleaning frame 71 via a charging roller bearing 67 at each of end portions with respect to a longitudinal direction (substantially parallel to a rotational axis direction of the drum 62) of the cleaning frame 71. The charging roller 66 is press-contacted to the drum 62 by pressing the charging roller bearing 67 toward the drum 62 by an urging member 68. As a result, the charging roller 66 is rotated by the rotation of the drum 62.

On the other hand, the developing unit 20 includes a developing roller 32, a developing container 23 for supporting the developing roller 32, a bottom member 22 provided integrally with the developing container 23, a developing blade 42, and the like. Inside the developing roller 32, a magnet roller 34 is provided so that the developer can be carried on the surface of the developing roller 32. Further, the developing blade 42 is provided in contact with the developing roller 32, so that a toner layer on the developing roller 32 can be regulated.

Further, a developing roller contact sheet 33 for preventing leakage of the toner from the developing unit 20 is provided in contact with the developing roller 32 at an edge portion of the bottom member 22. Further, a toner chamber 29 for accommodating a toner T is formed by integrally providing the developing container 23 and the bottom member 22. In the toner chamber 29, first to third feeding members 43, 44 and 50 are provided. The first to third feeding members 43, 44 and 50 are constituted so that these feeding members can stir the toner accommodated in the toner chamber 29 and can feed the toner to a toner supplying chamber 28.

(Image Forming Process)

An outline of an image forming process will be described using FIGS. 2 and 3. On the basis of a print start signal, the drum 62 is rotationally driven at a predetermined peripheral speed (process speed) in the arrow R direction. Further, the charging roller 66 to which a bias voltage is applied contacts the outer peripheral surface of the drum 62 and electrically charges the outer peripheral surface of the drum 62 uniformly.

The exposure device 3 outputs laser light L depending on image information. The laser light L passes through a laser opening 71*h* provided in the cleaning unit 60 (cleaning frame 71), so that the outer peripheral surface of the drum 62 is subjected to scanning exposure. As a result, on the outer peripheral surface of the drum 62, the electrostatic latent image depending on the image information is formed.

On the other hand, the toner T in the toner chamber 29 provided in the developing unit 20 (second unit) as a developing device of the cartridge B is stirred and fed by rotation of the first feeding member 43, the second feeding member 44 and the third feeding member 50, thus being sent to the toner supplying chamber 28. The toner T as the developer is carried by a magnetic force of a magnet roller 34 (fixed magnet) on a surface of the developing roller 32 as a developer carrying member. The toner T is regulated in layer thickness on the peripheral surface of the developing roller 32 by the developing blade 42 as the developing member while being triboelectrically charged. The toner T is supplied onto the drum 62 depending on the electrostatic latent image, so that the electrostatic latent image is visualized (developed) as a toner image (developer image).

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11.

On the other hand, as shown in FIG. 3, from the drum 62 after the transfer, a residual toner remaining on the outer peripheral surface of the drum 62 is removed by the cleaning blade 77 as a contact member for removing the developer on the image bearing member and as a collecting member for collecting the developer, and the drum 62 is used again in the image forming process. The residual toner removed from the drum 62 is stored in a residual toner chamber 71*b* as an accommodating portion of a cleaning unit 60.

In the above, the charging roller 66, the developing roller 32, the transfer roller 7 and the cleaning blade 77 are process means actable on the drum 62.

(Mounting and Demounting of Cartridge)

Figure 5:
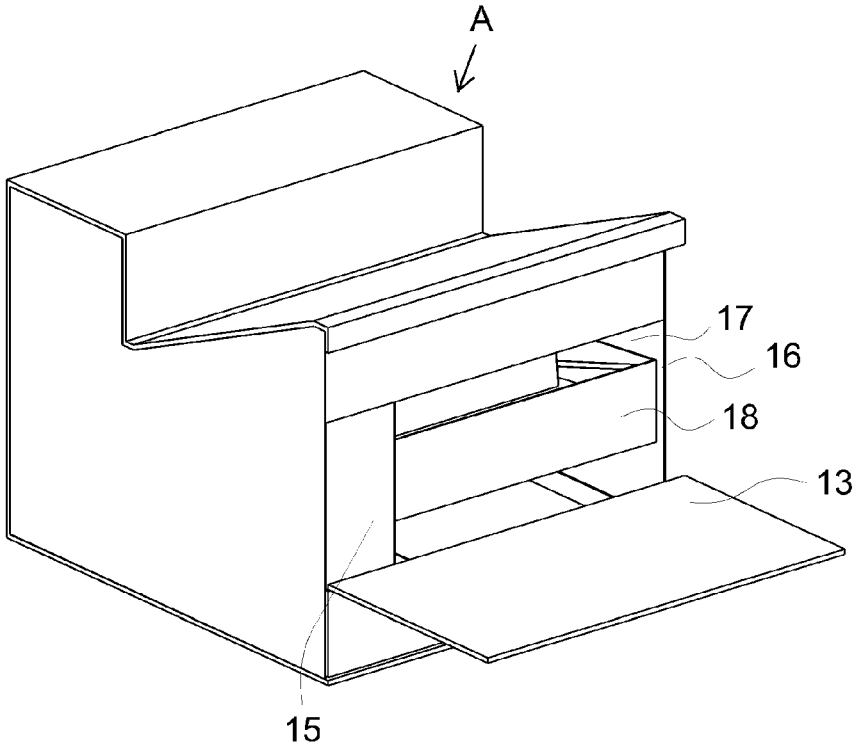
FIG. 5 is a perspective view of the image forming apparatus main assembly in a state in which an openable door of the image forming apparatus in First Embodiment is open.
Figure 6:
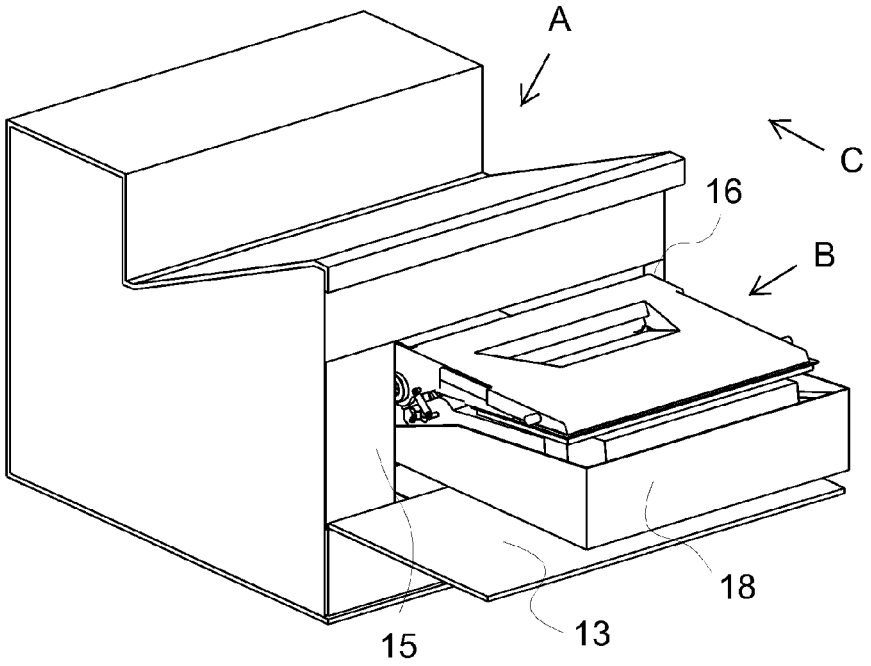
FIG. 6 is a perspective view of the image forming apparatus main assembly in a state in which the openable door of the image forming apparatus in First Embodiment is opened and then a tray is pulled out.
Figure 7:
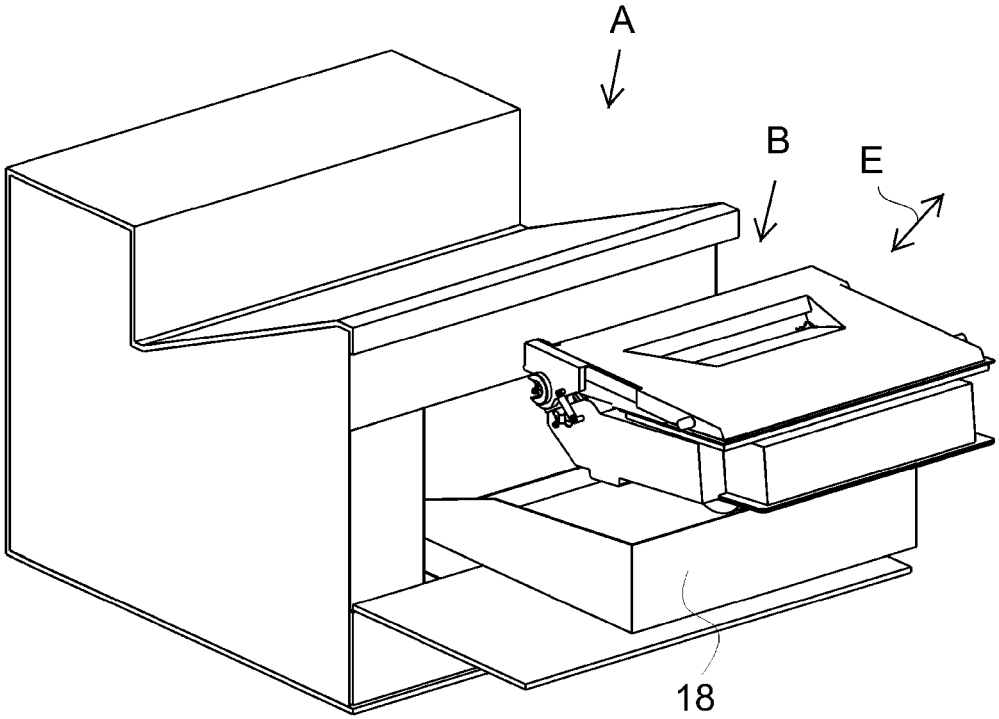
FIG. 7 is a perspective view of the image forming apparatus main assembly and the process cartridge when the process cartridge is mounted in and demounted from the tray in the state in which the openable door of the image forming apparatus in First Embodiment is opened and then the tray is pulled out.

Next, mounting and demounting of the cartridge B will be described using FIGS. 5 to 7. FIG. 5 is a perspective view of the apparatus main assembly A of which an openable door 13 is opened for permitting mounting and demounting of the cartridge B. FIG. 6 is a perspective view of the apparatus main assembly A and the cartridge B in a state in which the openable door 13 is opened for permitting the mounting and demounting of the cartridge B and then a tray 18 is pulled out. FIG. 7 is a perspective view of the apparatus main assembly A and the cartridge B when the cartridge B is mounted and demounted in the state in which the openable door 13 is opened and then the tray 18 is pulled out. The cartridge B is mountable in and demountable from the tray 18 along a mounting and demounting direction E.

To the apparatus main assembly A, the openable door 13 is rotatably attached, and when the openable door 13 is opened, a cartridge inserting opening 17 is exposed. In the cartridge inserting opening 17, the tray 18 for mounting the cartridge B in the apparatus main assembly A is provided. When the tray 18 is pulled out to a predetermined position, the cartridge B can be mounted and demounted. The cartridge B is inserted (mounted) in the apparatus main assembly A along a guide rail (not shown) in an arrow C direction in FIG. 6 in a state in which the cartridge B is placed on the tray 18.

Figure 8:
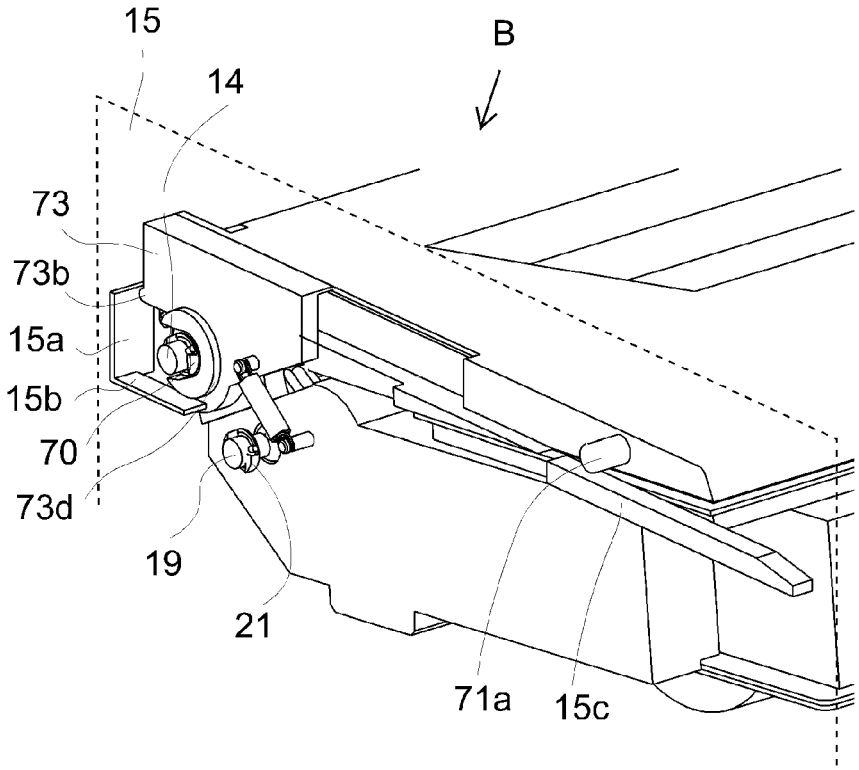
FIG. 8 is a perspective view showing a driving side positioning portion between the process cartridge and the image forming apparatus main assembly in a state in which the process cartridge is mounted in the image forming apparatus main assembly in First Embodiment.
Figure 9:
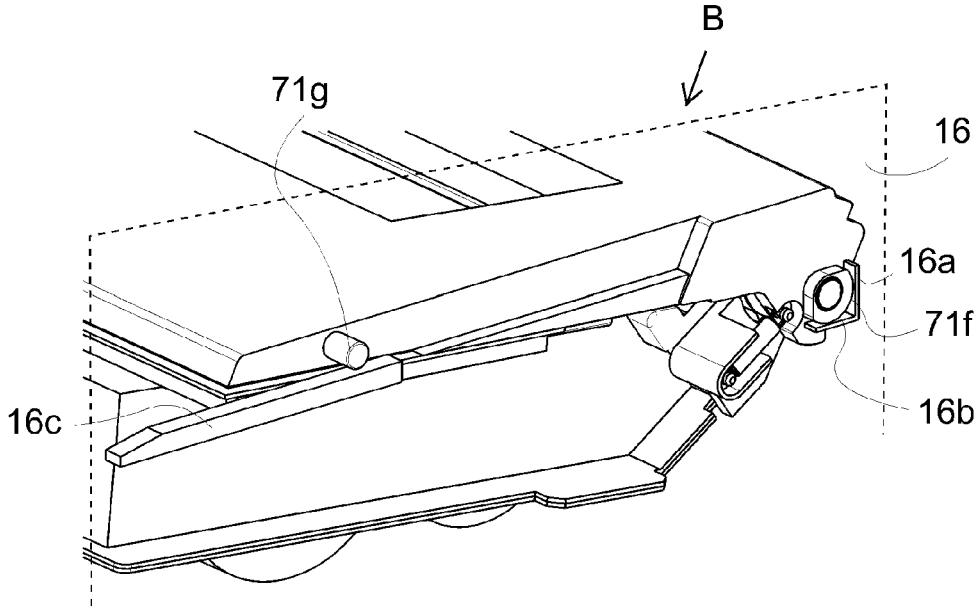
FIG. 9 is a perspective view showing a non-driving side positioning portion between the process cartridge and the image forming apparatus main assembly in the state in which the process cartridge is mounted in the image forming apparatus main assembly in First Embodiment.

The apparatus main assembly A is provided with a first main assembly(-side) driving shaft 14 and a second main assembly(-side) driving shaft 19 for transmitting a driving force to a first coupling 70 and a second coupling 21, respectively (FIG. 8). The first main assembly driving shaft 14 and the second main assembly driving shaft 19 are driven by a motor (not shown) as a driving source for the apparatus main assembly A. As a result, the drum 62 connecting with the first coupling 70 receives the driving force from the apparatus main assembly A and is rotated. The developing roller 32 is rotated by transmission of the driving force from the second coupling 21. Further, to the charging roller 66 and the developing roller 32, electric power is supplied by an electric power supplying portion (not shown) of the apparatus main assembly A.

(Support of Cartridge)

As shown in FIG. 5, the apparatus main assembly A is provided with a driving side-side plate 15 and the non-driving side-side plate 16 for supporting the cartridge B. The driving side-side plate 15 is provided with a driving side-first supporting portion 15*a*, a driving side-second supporting portion 15*b* and a rotation supporting portion for the cartridge B. The non-driving side-side plate 16 is provided with a non-driving side-first supporting portion 16*a*, a non-driving side-second supporting portion 16*b* and a rotation supporting portion 16*c* for the cartridge B.

On the other hand, as portions-to-be-supported of the cartridge B, a portion-to-be-supported 73*b* and a portion-to-be-supported 73*d* of a drum bearing 73, and a driving side boss 71*a*, a non-driving side projection 71*f* and a non-driving side boss 71*g* of the cleaning frame 71 are provided. The portion-to-be-supported 73*b* is supported by the driving side-first supporting portion 15*a*, the portion-to-be-supported 73*d* is supported by the driving side-second supporting portion 15*b*, and the driving side boss 71*a* is supported by the rotation supporting portion 15*c*. Further, the non-driving side projection 71*f* is supported by the non-driving side-first supporting portion 16*a* and the non-driving side-second supporting portion 16*b*, and the non-driving side boss 71*g* is supported by the rotation supporting portion 16*c*, so that the cartridge B is positioned inside the apparatus main assembly A.

(General Structure of Cartridge)

Figure 4:
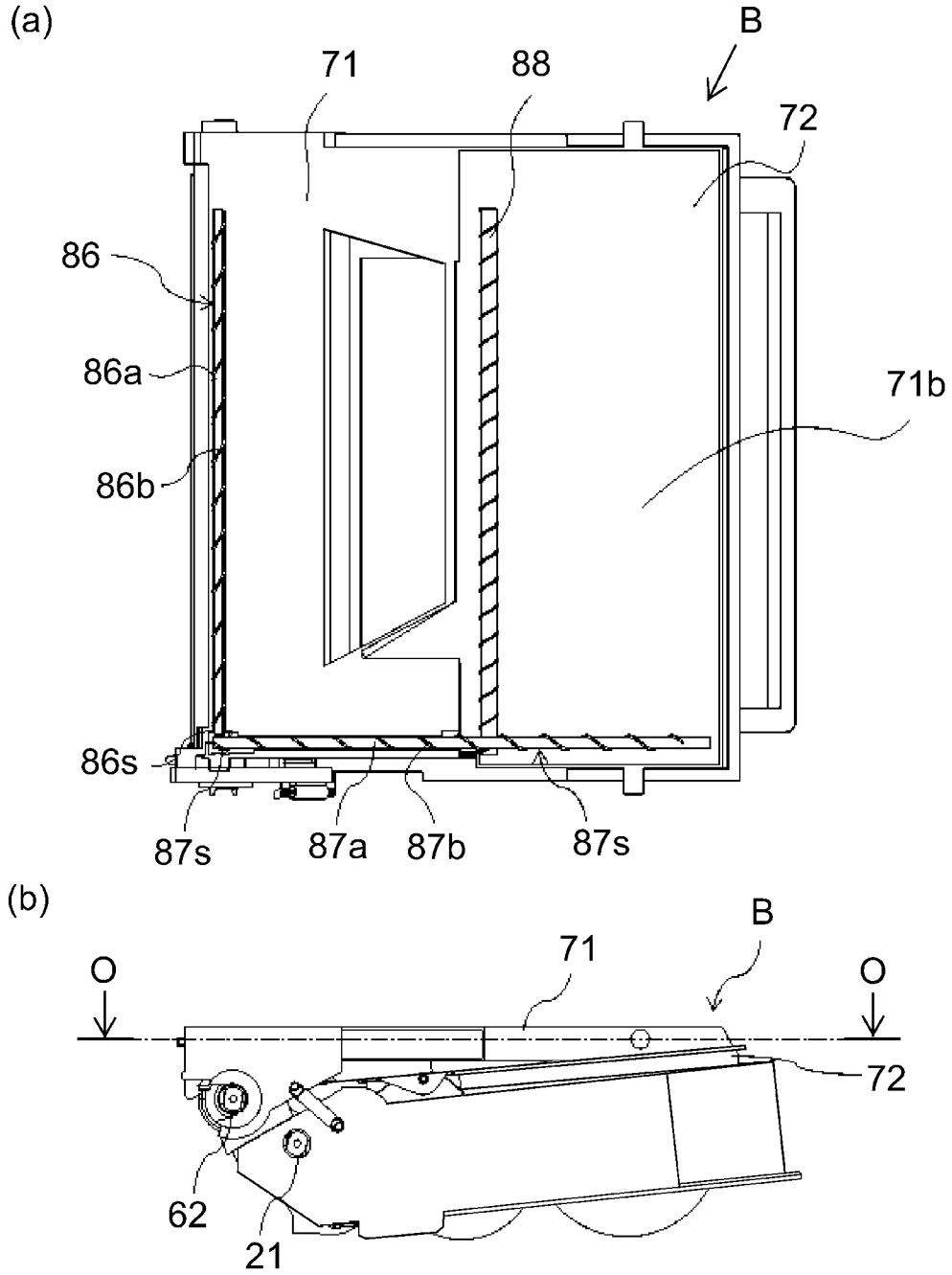
In FIG. 4, (a) and (b) are a sectional view and a side view, respectively, showing an inside of a cleaning container of the process cartridge in First Embodiment.

In FIG. 4, (a) and (b) are a sectional view and a side view, respectively, of the cleaning frame 71. An O-O cross-section of the cartridge B shown in (b) of FIG. 4 is shown in (a) of FIG. 4. As shown in FIGS. 3 and 4, the residual toner removed from the surface of the drum 62 by the cleaning member 77 is fed by a first screw 86, a second screw 87 and a third screw 88 which are residual toner feeding members.

Then, the residual toner is accumulated in a residual toner chamber 71*b* formed by the cleaning frame 71 and the cap member 72.

In a residual toner feeding system in this embodiment, the first screw 86 is provided in the neighborhood of the drum 62, and the second screw 87 is provided to an end portion of the cleaning frame 71 on the driving side with respect to the longitudinal direction. The first screw 86 includes a rotation shaft 86*a*, a helical blade (feeding portion) 86*b* formed outside (on an outer peripheral surface of) the rotation shaft 86*a*, and a drive transmitting portion 86*s* for transmitting the driving force to the rotation shaft 86*a*.

On the other hand, the second screw 87 includes a rotation shaft 87*a*, a helical blade (feeding portion) 87*b* formed outside (on an outer peripheral surface of) the rotation shaft 87*a*, and a driven shaft 87*s* for receiving the driving force from the rotation shaft 87*a*. Here, the drive transmitting portion 86*s* is a shaft rotated about an axis (center line of a driving shaft) by receiving the driving force from a driving source (motor). Further, the driven shaft is a shaft rotated by receiving the driving force from the driving shaft.

The first screw 86 receives the driving force transmitted from the coupling 21 to the drive transmitting portion 86*s* by a gear (not shown). The second screw 87 is rotated by receiving the driving force from the first screw 86 to the drive transmitting portion 86*s*. The third screw 88 is rotated by receiving the driving force from the second screw 87. The first screw 86 is disposed in the neighborhood of the drum 62, the second screw 87 is disposed at a longitudinal end portion of the cleaning frame 71, and the third screw 88 is disposed inside the residual toner chamber 71*b*. Here, a rotational axis of the first screw 86 and a rotational axis of the third screw 88 are parallel to a rotational axis of the drum 62, and a rotational axis of the second screw 87 is perpendicular to the rotational axis of the drum 61. Incidentally, as shown in FIG. 3, the drum contact sheet 65 is provided at an edge portion of the cleaning frame 71 so as to contact the drum 62.

Figure 10:
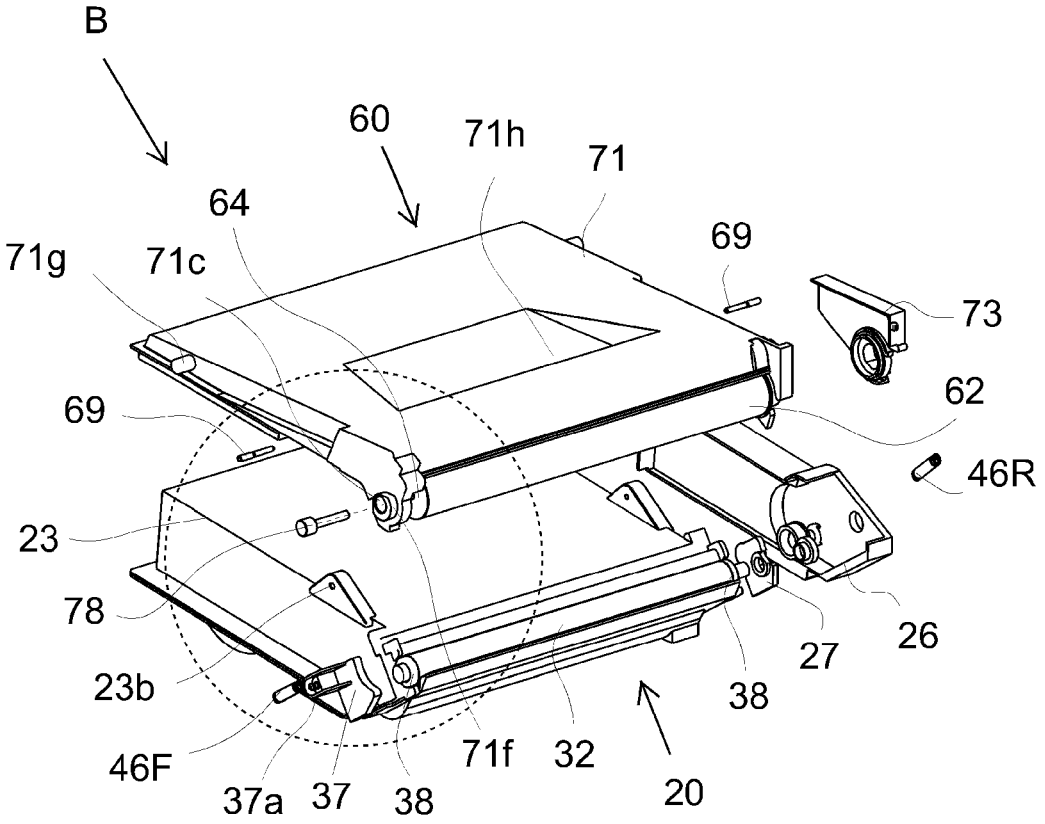
FIGS. 10 to 13 are exploded perspective views each showing the process cartridge in First Embodiment.
Figure 11:
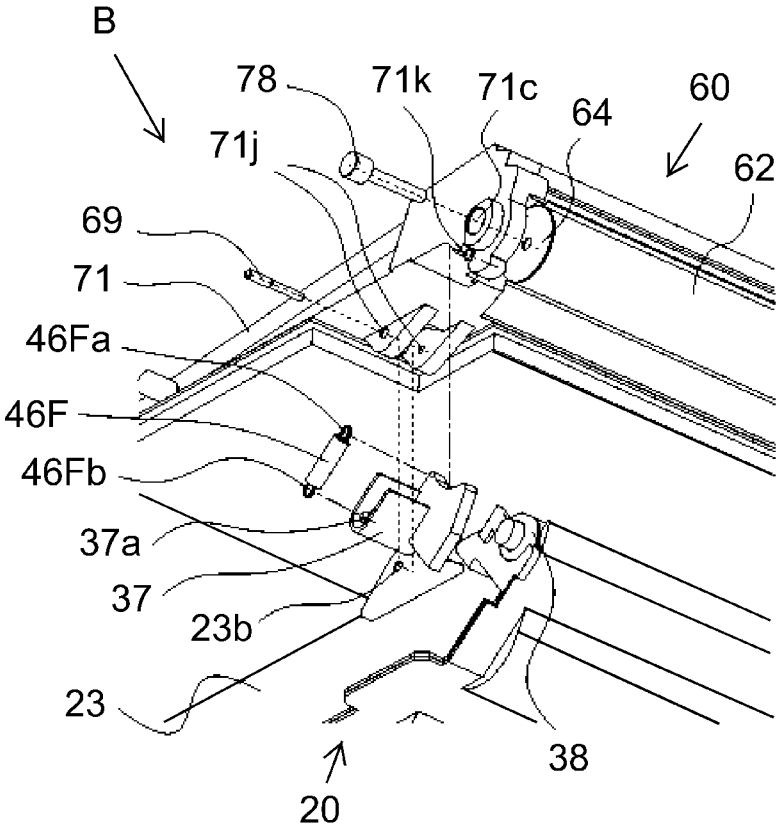
Figure 12:
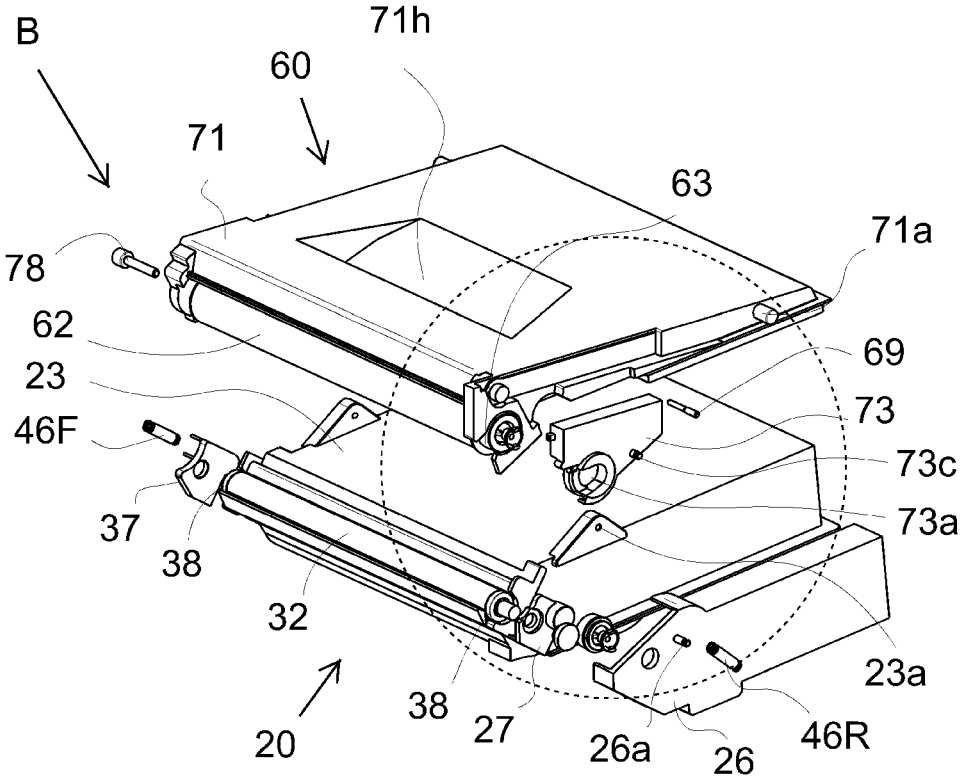
Figure 13:
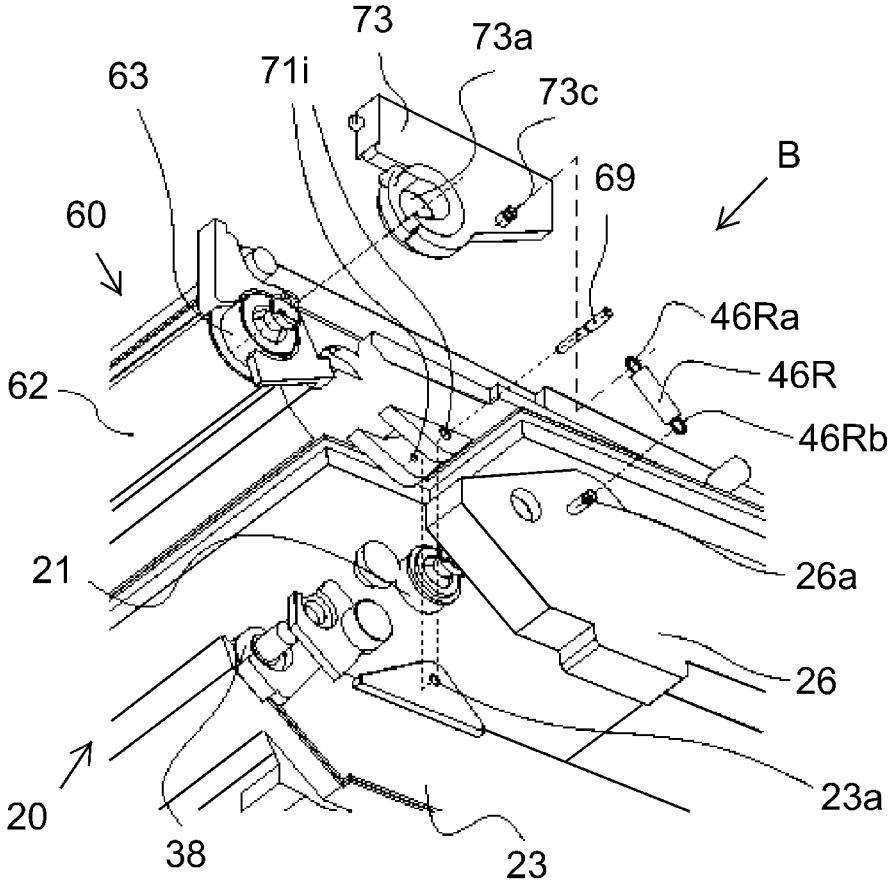

As shown in FIGS. 10 and 12, the cartridge B is constituted by combining the cleaning unit 60 and the developing unit 20. The cleaning unit 60 includes the cleaning frame 71, the cap member 72, the drum 62, the drum bearing 73 and a drum shaft 78 which are used for rotatably supporting the drum 62. As shown in FIG. 13, on the driving side of the drum 62, a driving side drum flange 63 provided on the driving side is rotatably supported by a hole 73*a*. On the other hand, as shown in FIG. 11, on the non-driving side of the drum 62, the drum shaft 78 press-fitted in a hole 71*c* provided in the cleaning frame 71 is rotatably supported by being placed in a state in which the drum shaft 78 is inserted into a hole of a non-driving side drum flange 64.

On the other hand, as shown in FIGS. 3, 10 and 12, the developing unit 20 includes the bottom member 22, the developing container 23, the driving side-developing side member 26, the developing blade 42, the developing roller 32 and the like. Further, by bearing members 27 and 37 provided at end portions of the developing roller 32, the developing roller 32 is rotatably attached to the developing container 23.

Then, as shown in FIGS. 11 and 13, the cartridge B is constituted by rotatably connecting the cleaning unit 60 and the developing unit 20 by connecting pins 69 relative to each other. Specifically, a developing-first supporting hole 23*a* and a developing-second supporting hole 23*b* are provided in the developing container 23 at longitudinal end portions of the developing unit 20. Further, at longitudinal end portions of the cleaning unit 60, first hanging holes 71*i* (FIG. 13) and second hanging holes 71*j* (FIG. 11) are provided in the cleaning frame 71.

Then, by engagement of the connecting pins 69 press-fitted and fixed in the first hanging holes 71*i* and the second hanging holes 71*j* with the first supporting hole 23*a* and the second supporting hole 23*b*, the cleaning unit 60 and the developing unit 20 are rotatably connected with each other.

Further, a first hole 46Ra of a driving side-urging member 46R is hooked on a boss 73*c* of the drum bearing member 73, and a second hole 46Rb of the driving side-urging member 46R is hooked on a boss 26*a* of the driving side-developing side member 26 (FIGS. 10 and 13). Further, a first hole 46Fa of a non-driving side-urging member 46F is hooked on a boss 71*k* of the cleaning frame 71, and a second hole 46Fb of the non-driving side-urging member 46F is hooked on a boss 37*a* of the bearing member 37 (FIGS. 11 and 12).

In this embodiment, each of the driving side-urging member 46R and the non-driving side-urging member 46F is formed with a tension spring, and the developing unit 20 is urged toward the cleaning unit 60 by an urging force of these springs. As a result, the developing roller 32 is constituted so as to be pressed toward the drum 62 with reliability. As shown in FIGS. 10 and 12, a gap maintaining member 38 is attached to each of the end portions of the developing roller 32, and contacts the drum 62, so that the developing roller 32 is held with a minute gap with the drum 62. Thus, by the gap maintaining members 38 provided at the end portions of the developing roller 32, the developing roller 32 is held with a predetermined gap from the drum 62.

(Detailed of Cleaning Portion)

Figure 1:
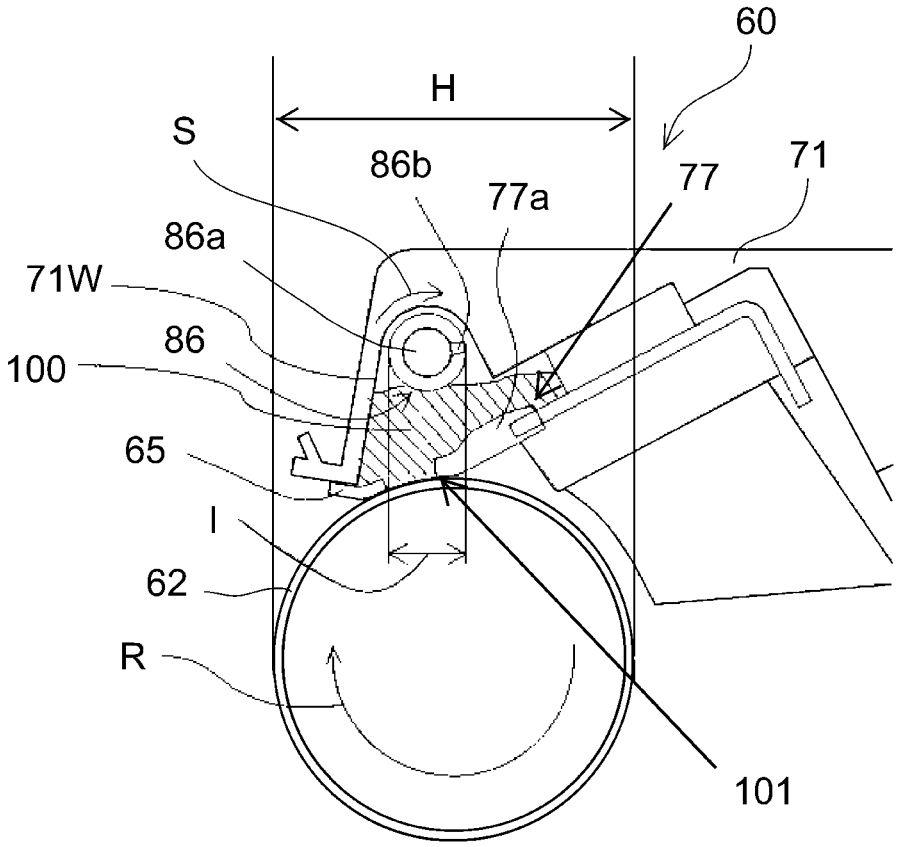
FIG. 1 is a sectional view of a process cartridge according to First Embodiment to which the present invention is applicable.
Figure 14:
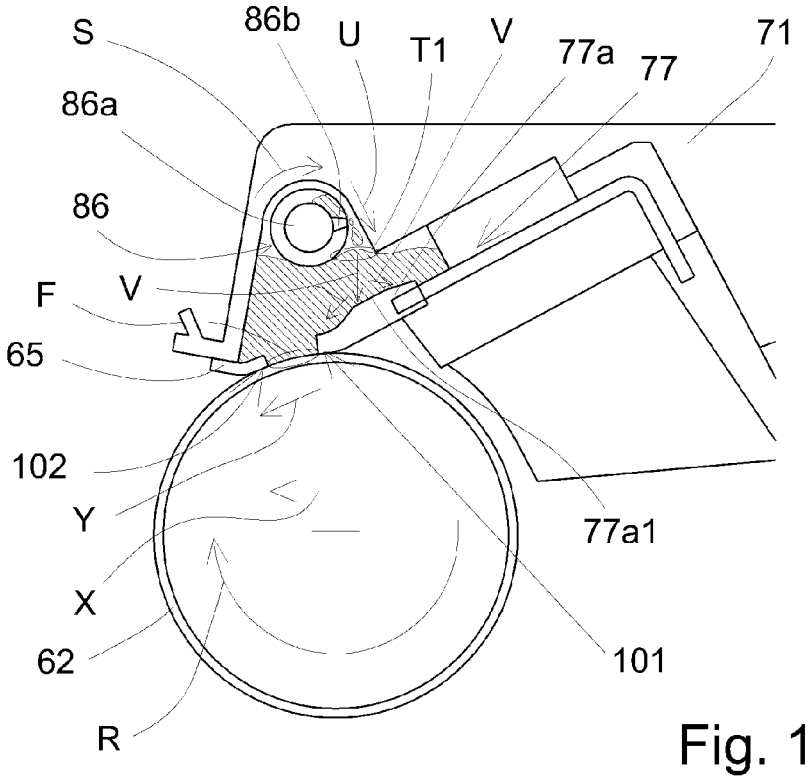
FIGS. 14 and 15 are sectional views each showing the process cartridge in First Embodiment.
Figure 15:
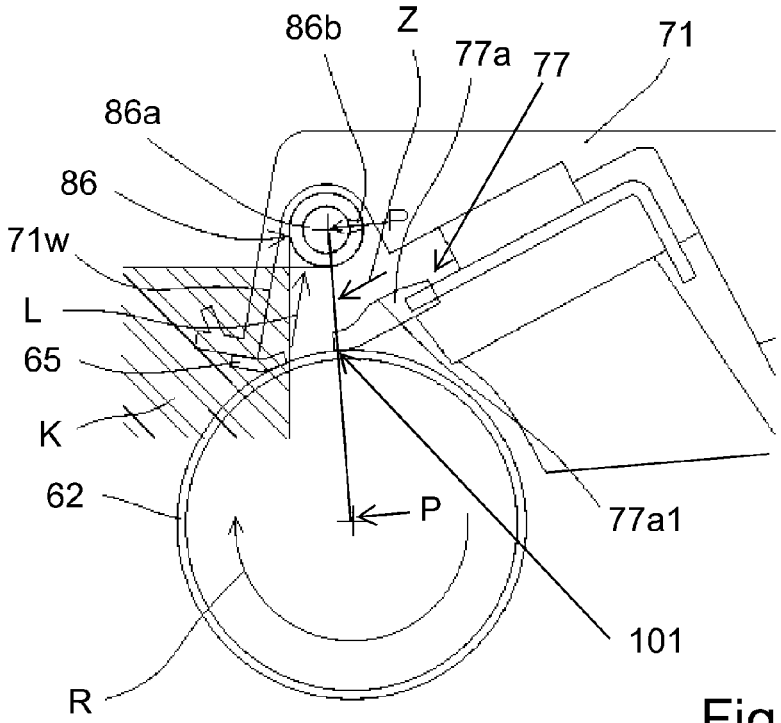

Next, details of a portion where the cleaning is effected will be described using FIGS. 1, 14 and 15. FIGS. 1, 14 and 15 are schematic views each showing a cross-section of a constituent portion relating to the cleaning in the cartridge as seen from the longitudinal direction.

As shown in FIG. 1, the first screw 86 is rotatably disposed in the cleaning frame 71 so that a rotation axis thereof and a rotation axis of the drum 62 are parallel to each other. The first screw 86 is provided with the helical blade 86*b* on the outside (the outer peripheral surface) of the rotation shaft 86*a*. Further, the first screw 86 is disposed inside the cleaning frame 71 so as to fall within the region H at a position vertically above the drum 62 as seen from a rotational axis direction.

The toner remaining on the surface of the drum 62 after the transfer passes through between the drum 62 and the drum contact sheet 65 to reach a region of the cleaning frame 71 and is scraped off from the drum 62 by the rubber blade 77*a* of the cleaning member 77. The toner scraped off by the cleaning member 77 is, as shown in FIG. 1, accumulated in an accommodating portion 100 defined by the cleaning frame 71, the drum contact sheet 65, the drum 62 and the cleaning member 77.

When an upper surface of the accumulated toner reaches a height where the toner contacts the first screw 86, with a rotational operation of the first screw 86, the toner accumulated by the helical blade 86*b* is fed from the accommodating portion 100 in the longitudinal direction (direction perpendicular to the drawing surface of FIG. 1).

The first screw 86 feeds the toner in the longitudinal direction, and at the same time scoops up the accumulated toner on the rotation shaft 86*a* by the helical blade 86*b*, and then feeds the toner along the rotational direction S of the first screw 86. As shown in FIG. 14, the toner fed along the rotational direction S of the first screw 86 is fed along a direction U and drops in a downstream side with respect to the rotational direction S of the first screw 86.

In the cleaning unit 60 in this embodiment, as shown in FIG. 1, the first screw 86 is disposed so that the contact portion 101 between the cleaning member 77 and the drum 62 falls within the region I at a position vertically below the first screw 86. In other words, the first screw 86 is disposed right above the contact portion 101 with respect to a vertical direction (direction of gravity). Here, the "right above" refers to such an arrangement relationship that the contact portion 101 overlaps with the first screw 86 (within the region I corresponding to a diameter) when the position of the contact portion 101 is parallely moved vertically upwardly. Further, in this embodiment, the rotational direction S of the first screw 86 and the rotational direction R of the drum 62 are the same.

In this way, the arrangement and rotational direction of the first screw 86 are determined, so that as shown in FIG. 14, the toner fed by the first screw 86 is further dropped on an upper surface T1 of the toner accommodated on the surface 77*a*1 of the cleaning member 77 (rubber blade 77*a*). That is, in FIG. 14, the toner fed by the first screw 86 does not drop on the toner accumulated on the contact portion 101 and a drum surface F upstream of the contact portion 101 with respect to the rotational direction R of the drum 62.

For this reason, pressure by the toner dropped from the first screw 86 is easily applied in such a manner that the toner is dispersed on the surface 77*a*1 of the cleaning member 77 on the downstream side with respect to the rotational direction R of the drum 62 as indicated by an arrow V. That is, the pressure by the toner dropped from the first screw 86 is not readily applied to the drum surface F upstream of the contact portion 101 with respect to the rotational direction R of the drum 62.

Accordingly, it is possible to suppress (decrease) the pressure by the toner applied to the contact portion 101. As a result, the toner remaining on the surface of the drum 62 after the transfer does not readily pass through the cleaning member 77, so that a cleaning performance can be improved.

That is, in the case where the pressure by the toner dropped from the first screw 86 is applied to the drum surface F upstream of the contact portion 101 with respect to the rotational direction R of the drum 62, with rotation of the drum 62, the cleaning member 77 is deformed upwardly by the pressure of the toner. As a result, it would be considered that such a problem that the toner passes through the cleaning member 77 occurs, but in this embodiment, this problem does not readily occur, and the deformation of the cleaning member 77 is suppressed, so that the cleaning performance can be improved.

Further, in this embodiment, as shown in FIG. 14, the contact portion 102 between the drum contact sheet 65 and the drum 62 was disposed below the contact portion 101 between the cleaning member 77 and the drum 62 with respect to the vertical direction (direction of gravity). For this reason, in a region where the toner is accumulated inside the cleaning frame 71, the contact portion 102 is in the lowest position with respect to the vertical direction (direction of gravity). As a result, the pressure by the toner is easily dispersed (distributed) on the contact portion 102 than the contact portion 101, so that it is possible to lower the pressure by the toner applied to the contact portion 101.

Further, in this embodiment, the cleaning member 77 is disposed so that the contact portion 101 is positioned in, of the surface of the drum 62 positioned at a vertically above portion, a region X upstream of a top (point) of the drum 62 with respect to the rotational direction R of the drum 62. That is, within a range of crossing positions between a horizontal surface passing through the rotation center of the drum 62 and a peripheral surface of the drum 62, the contact portion 101 is disposed upstream of the top position of the drum 62 with respect to the rotational direction R of the drum 62. As a result, the drum surface F constitutes a surface extending downward (in Y direction) with respect to the horizontal direction with a position toward the upstream side with respect to the rotational direction R of the drum 62, and therefore the pressure by the toner is easily dispersed on the contact portion 102 than the contact portion 101. As a result, the above-described effect of lowering the pressure by the toner applied to the contact portion 101 can be obtained further reliably.

Further, in this embodiment, as shown in FIG. 15, a wall surface 71W as a part of an inner wall of the cleaning frame 71 is provided. With respect to the axial direction of the drum 62, the wall surface 71W is provided at least at a part of a region where an opening of the residual toner chamber 71*b* and the helical blade 86*b* are formed. Further, with respect to the vertical direction (direction of gravity), at least a part of the wall surface 71W is positioned below the first screw 86 and is inclined obliquely downwardly from the first screw 86. Specifically, in a flat surface perpendicular to the axial direction of the drum 62, the wall surface 71W is positioned in the drum contact sheet 75 side with respect to a P-P rectilinear line connecting the rotation center of the drum 62 and the rotation center of the first screw 86. The wall surface 71W is provided and inclined so as to approach the P-P rectilinear line with an increasing level with respect to the vertical direction.

Thus, in this embodiment, in the flat surface (plane) perpendicular to the axial direction of the drum 62 shown in FIG. 15, the wall surface 71W is provided so that a horizontal position thereof is in a region K which is positioned in the drum contact sheet 65 wide and which is positioned below the first screw 86 with respect to the vertical direction. Further, the wall surface 71W is provided along a single flat surface which is inclined along such a direction L as to approach the first screw 86 with an increasing level with respect to the vertical direction.

The wall surface 71W is provided along such a single flat surface, and therefore by flow of the toner along this flat surface, the toner can be moved toward the first screw 86 while suppressing loss of the toner. In this way, in this embodiment, a feeding property of the toner moving toward the first screw 86 along the wall surface 71W can be improved. Incidentally, in this embodiment, the wall surface 71W is the single flat surface, but may only be required to be a surface (plane) extending along the flow of the toner, and for example, the wall surface 71W may also be a surface provided with a groove extending along the flow of the toner.

That is, with respect to the flat surface perpendicular to the axial direction of the drum 62, the wall surface 71W is disposed so that the position thereof with respect to the horizontal direction (axial direction) is in the drum contact sheet 65 side (opposite from the cleaning member 77 side).

Further, in this embodiment, as shown in FIG. 15, the surface 77*a*1 of the cleaning member 77 is provided so as to extend obliquely downwardly (in Z direction) with respect to the horizontal direction from the cleaning member 77 toward the drum contact sheet 65. As a result, a drop action due to gravitation acts on the surface 77*a*1, and therefore stagnation of the toner on the surface 77*a*1 can be suppressed. As a result, the toner feeding property can be improved.

Second Embodiment

Second Embodiment of the present invention will be described. In Second Embodiment, a portion (cleaning portion) different from that in First Embodiment will be described in detail. Unless otherwise specified, materials and shapes of portions are similar to those in First Embodiment. The portions are represented by the same reference numerals or symbols and will be omitted from detailed description.

Figure 16:
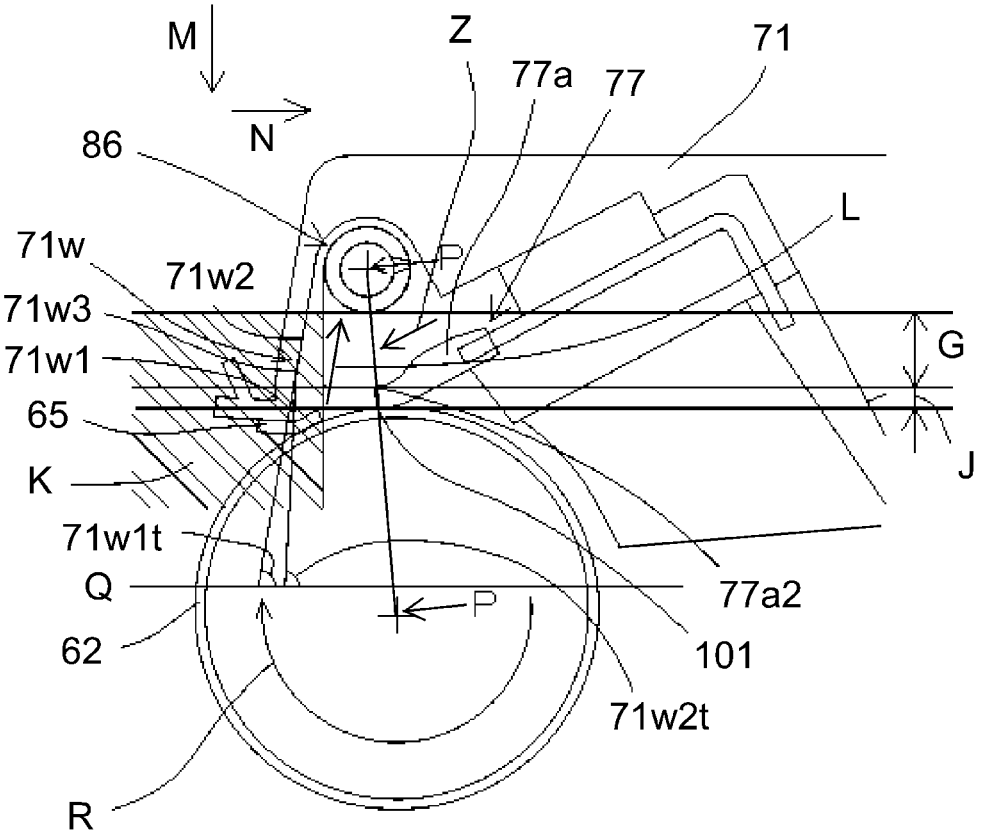
FIG. 16 is a sectional view of a process cartridge in Second Embodiment.

In this embodiment, as shown in FIG. 16, a wall surface 71*w* is provided as a part of an inner wall of a cleaning frame 71. In a flat surface perpendicular to an axial direction of a drum 62, the wall surface 71*w* is provided so that a horizontal position thereof is in a region K which is positioned in a drum contact sheet 65 side and which is positioned below a first screw 86 with respect to a vertical direction. Further, the wall surface 71*w* in this embodiment is constituted by a first flat surface 71*w*1 and a second flat surface 71*w*2 connected with the first flat surface 71*w*1. The first flat surface 71*w*1 is disposed below (under) the second flat surface 71*w*2 with respect to the vertical direction. Each of the first flat surface 71*w*1 and the second flat surface 71*w*2 is a single flat surface inclined along a direction L so that the flat surface approaches the first screw 86 with an increasing level with respect to the vertical direction. That is, each of the first flat surface 71*w*1 and the second flat surface 71*w*2 is, in the flat surface perpendicular to the axial direction of the drum 62, positioned in the drum contact sheet 65 side with respect to a P-P rectilinear line connecting a rotation center of the drum 62 and a rotation center of the first screw 86. Each of the first flat surface 71*w*1 and the second flat surface 71*w*2 is provided and inclined so as to approach the P-P rectilinear line with an increasing level of the wall surface 71*w*. An angle formed between the second flat surface 71*w*2 and a horizontal surface Q, i.e., an acute angle 71*w*2*t* is constituted so as to be smaller than an angle formed between the first flat surface 72*w*1 and the horizontal surface Q, i.e., an acute angle 72*w*1*t*.

Further, a cleaning member 77 (rubber blade 77*a*) has an edge portion 77*a*2 positioned closest to the first flat surface 71*w*1 with respect to the horizontal direction. Here, with respect to the vertical direction, a region between a lowermost point of the first screw 86 and a top point of the edge portion 77*a*2, i.e., a lowermost point of a surface of the cleaning member 77 (rubber blade 77*a*) exposed upwardly is taken as a region G. In this embodiment, a constitution in which the first flat surface 71*w*1, a connecting point 71*w*3 and the second flat surface 71*w*2 are provided in the listed order from below with respect to the vertical direction and in which the connecting point 71*w*3 connecting the first flat surface 71*w*1 and the second flat surface 71*w*2 is provided in the region G is employed.

By employing the above constitution, not only the toner can be moved toward the first screw 86 while suppressing loss of flow of the toner along the wall surface 71*w* but also a toner flow path in a region J can be broadened, and therefore a feeding property of the toner toward the first screw 86 along the wall surface 71*w* can be improved. Incidentally, the region J below the edge portion 77*a*2 and above the contact portion 101 between the cleaning member 77 and the drum 62 with respect to the vertical direction.

Incidentally, the acute angle 71*w*2 may preferably be 45° to 84°. By providing the acute angle 71*w*2*t* of 45° or more, a component of a drag force, with respect to the vertical direction (M direction), received from the wall surface 71*w* by the toner shown in FIG. 16 can be made not more than a component of the drag force with respect to the horizontal direction (N direction). For this reason, the drag force received from the second flat surface 71*w*2 can be made sufficiently small. Further, by providing the acute angle 71*w*2*t* of 84° or less, a component of a drag force, with respect to the horizontal direction (N direction), received from the acute angle 71*w*2*t* by the toner can be made 10% or more of a component of the drag force with respect to the vertical direction (M direction). For this reason, the toner can be caused to sufficiently approach the first screw 86 by the wall surface 71*w*.

Further, with respect to a relationship of arrangement of respective members and a shape of the wall surface 71*w* in this embodiment, it is possible to obtain an effect by providing the members in a part of a region, with respect to the longitudinal direction, in which an image is formed. However, with respect to the longitudinal direction, in an entirety of the region in which the image is formed, the relationship of arrangement of the respective members and the shape of the wall surface 71*w* are provided, whereby the effect can be obtained further with reliability.

MODIFIED EMBODIMENTS

Preferred embodiments of the present invention were described above, but the present invention is not limited thereto. Various modifications and changes of constitutions of the present invention are possible within the scope of the present invention. Incidentally, with respect to functions, materials, shapes and relative arrangement of constituent elements described in the above embodiments, the scope of the present invention is not intended to be limited only to these parameters.

Modified Embodiment 1

Further, with respect to a relationship of arrangement of respective members and a shape of the wall surface (71*w*) in the above-described embodiments, it is possible to obtain an effect by providing the members in a part of a region, with respect to the longitudinal direction, in which an image is formed. However, with respect to the longitudinal direction, in an entirety of the region in which the image is formed, the relationship and the shape may also be provided, whereby the effect thereof can be obtained further with reliability.

Modified Embodiment 2

In the above-described embodiments, as the developer feeding member, the mechanism using the first screw 86 and the second screw 87 was described, but the developer feeding member is not limited to the screw. For example, the developer feeding member may also be a flexible sheet provided on a rotation shaft so as to feed the developer in a radial direction.

Modified Embodiment 3

The constitution relating to the screw member described in the above-described embodiments is not limited to the constitution for feeding the residual toner, but may also be used for feeding the developer in the developing device. That is, in the above-mentioned embodiments, the constitution in which as a carrying for carrying the developer, the drum 62 which is the image bearing member for bearing the developer image is provided and in which the cleaning device including the cleaning member 77 as a contact member contacting the drum 62 was described, but the present invention is not limited thereto.

That is, the constitution may also be such a developing device that the developing roller 32 is provided as a developer carrying member for carrying the developer supplied to the drum 62 as the carrying member, that the contact member contacting the developing roller 32 is a developing blade 42 and that a feeding device feeds the developer from the accommodating portion to the developing roller 32 may also be employed. In this case, a sheet member corresponding to the sheet member (drum contact sheet 65) contacting the drum 62 contacts the developing roller 32.

Further, the present invention may also be, as the process cartridge insertable into the apparatus main assembly of the image forming apparatus, a process cartridge including the drum 62, the feeding device and at least one of the above-described cleaning device and developing device.

Modified Embodiment 4

In the above-described embodiments, the feeding device for feeding the developer is provided in the process cartridge insertable into the apparatus main assembly of the image forming apparatus, but may also be provided in an apparatus main assembly of an image forming apparatus in which the process cartridge is not used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-099904 filed on May 15, 2015, and 2016-078267 filed on Apr. 8, 2016, which are hereby incorporated by reference herein in their entirety.

What is claimed is:

1. A feeding device for feeding developer, the feeding device comprising:

a cleaning member for removing developer on an image bearing member, the cleaning member being in contact with the image bearing member, and the cleaning member extending toward an upstream side with respect to a rotational direction of the image bearing member;

an accommodating portion for accommodating the removed developer;

a feeding member for feeding the developer from the accommodating portion; and a sheet member fixed to the accommodating portion and contacting the image bearing member, wherein a wall surface of the accommodating portion is positioned on a side where the sheet member is provided with respect to a rectilinear line connecting a rotation center of the image bearing member and a rotation center of the feeding member in a flat plane perpendicular to an axial direction of the image bearing member, wherein the wall surface approaches the rectilinear line with an increasing level with respect to a vertical direction so as to guide the developer to the feeding member, wherein the feeding member is provided vertically above a position where the cleaning member contacts the image bearing member such that the feeding member overlaps a part of the cleaning member and a part of the image bearing member that is upstream of the cleaning member with respect to the rotational direction of the image bearing member, and wherein a rotational direction of the feeding member and a rotational direction of the image bearing member are the same.

2. A feeding device according to claim 1, wherein the feeding member is a screw including a rotation shaft and a helical blade provided on an outer peripheral surface of the rotation shaft.

3. A feeding device according to claim 2, wherein the wall surface includes a first flat surface and a second flat surface from vertically below, and wherein each of the first flat surface and the second flat surface approaches the rectilinear line with an increasing level with respect to the vertical direction.

4. A feeding device according to claim 3, wherein an angle formed between the second flat surface and a horizontal surface is smaller than an angle formed between the first flat surface and the horizontal surface.

5. A feeding device according to claim 3, wherein the second flat surface has an angle of 45° to 84° relative to a horizontal surface.

6. A feeding device according to claim 3, wherein the wall surface has a connecting point where the first flat surface and the second flat surface are connected with each other, and wherein, with respect to the vertical direction, the connecting point is positioned between a lowermost point of the feeding member and a lowermost point of an exposed surface vertically above the cleaning member.

7. A feeding device according to claim 2, wherein a position where the sheet member contacts the image bearing member is vertically below a position where the cleaning member contacts the image bearing member.

8. A feeding device according to claim 2, wherein a position where the cleaning member contacts the image bearing member is upstream of a top position of the image bearing member with respect to the rotational direction of the image bearing member.

9. A feeding device according to claim 2, wherein the cleaning member is provided obliquely downward with respect to a horizontal direction from the cleaning member toward the sheet member.

10. A feeding device according to claim 2, wherein the feeding member is disposed at a position vertically overlapping the position where the cleaning member contacts the image bearing member.

11. A feeding device according to claim 2, wherein the wall surface is a wall surface of a frame including the accommodating portion.

12. A process cartridge insertable into an apparatus main assembly of an image forming apparatus, the process cartridge comprising:

an image bearing member; and a feeding device according to claim 1.

13. A process cartridge according to claim 12, further comprising a developer carrying member for carrying a developer to be supplied to the image bearing member.

14. An image forming apparatus comprising:

an image bearing member;

a feeding device according to claim 1; and an exposure device for forming an electrostatic latent image on the image bearing member, wherein the image bearing member and the feeding member are provided in a process cartridge or a main assembly of the image forming apparatus using no process cartridge.

* * * * *